US007891524B1

(12) United States Patent
Johnson et al.

(10) Patent No.: US 7,891,524 B1
(45) Date of Patent: Feb. 22, 2011

(54) FUEL AND OIL MIXING DEVICE

(75) Inventors: R. Scott Johnson, Lawrenceburg, KY (US); Benjamin Lee Kessinger, III, Lexington, KY (US); Thomas M. McCullough, Lexington, KY (US); Kenneth M. Nielsen, Lexington, KY (US)

(73) Assignee: Precise Mix, LLC, Lexington, KY (US)

( * ) Notice: Subject to any disclaimer, the term of this patent is extended or adjusted under 35 U.S.C. 154(b) by 577 days.

(21) Appl. No.: 11/753,811

(22) Filed: May 25, 2007

Related U.S. Application Data

(60) Provisional application No. 60/803,268, filed on May 26, 2006.

(51) Int. Cl.
*B01F 5/04* (2006.01)

(52) U.S. Cl. ..... 222/145.5; 222/145.7; 222/454; 222/457; 137/896

(58) Field of Classification Search ..... 222/144.5, 222/145.5–145.7, 145.1, 165–166, 636, 437, 222/444, 454, 457
See application file for complete search history.

(56) References Cited

U.S. PATENT DOCUMENTS

| | | | | |
|---|---|---|---|---|
| 3,643,690 | A * | 2/1972 | Sarai | 137/587 |
| 3,800,978 | A * | 4/1974 | Sigwald | 220/746 |
| 3,979,010 | A * | 9/1976 | Fiedler et al. | 220/86.2 |
| 4,069,835 | A | 1/1978 | Stadler | |
| 4,121,631 | A | 10/1978 | Jones | |
| 4,262,710 | A | 4/1981 | Nomura et al. | |
| 4,286,632 | A | 9/1981 | Abel | |
| 4,381,741 | A | 5/1983 | Walsworth | |
| 4,383,504 | A | 5/1983 | Walsworth | |
| 4,594,971 | A | 6/1986 | Borst | |
| 4,846,373 | A * | 7/1989 | Penn et al. | 222/137 |
| 4,955,943 | A | 9/1990 | Hensel et al. | |
| 4,966,312 | A * | 10/1990 | Waring | 222/209 |
| 5,402,913 | A | 4/1995 | Graf | |
| 5,628,295 | A | 5/1997 | Todero et al. | |
| 5,632,241 | A | 5/1997 | Binversie et al. | |
| 6,655,335 | B2 | 12/2003 | Imafuku et al. | |
| 7,481,335 | B2 * | 1/2009 | Owens | 222/144.5 |
| 2004/0262331 | A1 * | 12/2004 | Woolfson et al. | 222/145.5 |
| 2005/0028436 | A1 | 2/2005 | Gantzer | |

FOREIGN PATENT DOCUMENTS

| | | |
|---|---|---|
| EP | 0590041 | 5/2007 |
| WO | 8204464 | 12/1982 |

* cited by examiner

*Primary Examiner*—Kenneth Bomberg
*Assistant Examiner*—Donnell Long
(74) *Attorney, Agent, or Firm*—Stites & Harbison, PLLC; David W. Nagle, Jr.

(57) ABSTRACT

A fuel and oil mixing device holds a quantity of fuel and oil and allows a user to easily select the ratio of fuel to oil in the mixture that exits the device, thus allowing a single device to be used to fill multiple two-stroke engines. The fuel and oil mixing device includes a mixing chamber defining an internal volume, a fuel intake opening, an oil intake opening, and an outlet. Fuel is delivered into the mixing chamber from the fuel reservoir through the fuel intake opening, while oil is delivered into the mixing chamber through the oil intake opening. An oil control valve controls oil flowing into the mixing chamber through the oil intake opening so as to allow the user to dispense a fuel-oil mixture through the outlet of the mixing chamber with a predetermined fuel-to-oil ratio.

19 Claims, 8 Drawing Sheets

FUEL AND OIL MIXING DEVICE

CROSS-REFERENCE TO RELATED APPLICATIONS

The present application claims priority to U.S. Provisional Patent Application Ser. No. 60/803,268 filed on May 26, 2006, the entire disclosure of which is incorporated herein by reference.

BACKGROUND OF THE INVENTION

Two-stroke engines are generally lighter, simpler, and less expensive than four-stroke or diesel engines. Therefore, many devices utilize two-stroke engines. For instance, radio-controlled toys, small outboard boat motors, jet skis, off-road motorcycles, and lawn and garden equipment (e.g., chain saws, leaf blowers, and weed trimmers) typically employ a two-stroke engine. Although the above-mentioned advantages lead to the widespread use of two-stroke engines, these engines possess disadvantages as well. For instance, in a four-stroke engine, the crankcase is completely separate from the combustion chamber, so the crankcase can be filled with oil to lubricate the engine. On the other hand, a two-stroke engine includes no separate oil chamber. To lubricate a two-stroke engine, oil must be mixed into the fuel that is introduced into the engine. Without the proper amount of oil in the fuel-oil mixture, a two-stroke engine will quickly seize and malfunction. Consequently, great care must be taken to ensure that the proper ratio of fuel to oil is in the mixture that is introduced into the engine.

In most cases, fuel and oil are maintained in separate containers, and then manually metered into and mixed in a third container. This task not only requires multiple containers, but it can also be messy and difficult. Such difficulty in mixing the fuel and oil for a two-stroke engine is exacerbated by the fact that many people own more than one device that employs a two-stroke engine. Since each two-stroke engine generally requires its own particular ratio of fuel to oil, owners of more than one device using a two-stroke engine must repeat the aforementioned mixing process for each device.

Accordingly, there remains a need in the art for a fuel and oil mixing device that allows a user to accurately and quickly mix the proper amounts of fuel and oil for multiple devices employing a two-stroke engine.

SUMMARY OF THE INVENTION

The present invention is a fuel and oil mixing device that holds a quantity of fuel and oil and allows a user to easily select the ratio of fuel to oil in the mixture that exits the device, thus allowing a single device to be used to fill multiple two-stroke engines.

An exemplary fuel and oil mixing device includes a fuel reservoir for holding a quantity of fuel, with this fuel reservoir defining an opening for exit of the fuel. An oil reservoir is secured to and supported by the fuel reservoir, and holds a quantity of oil. The oil reservoir includes an opening which allows oil to exit from the oil reservoir through a generally S-shaped oil trap, which defines as a pathway for oil from the oil reservoir to the remaining components of the device, as is further described below.

A fuel control valve is generally cylindrical in shape and defines a fuel conduit, that, when assembled with the remaining components of the fuel and oil mixing device, is in registry with the opening through which fuel exits the fuel reservoir. A mixing chamber is then connected to the fuel control valve, such that fuel will flow through the fuel control valve and into the mixing chamber via a generally U-shaped fuel trap. The fuel control valve is secured to the fuel reservoir through the use of a collar, which is assembled around the fuel control valve, engaging an integral circumferential lip of the fuel control valve, with the collar including internal threads for mating with external threads on the fuel reservoir.

The mixing chamber is generally cylindrical in shape and defines an internal volume. The mixing chamber also defines a fuel intake opening, an oil intake opening, and a screw-receiving boss. Finally, the mixing chamber defines an outlet, which is in registry with a conduit defined by a spout, with the fuel-oil mixture exiting the device through the spout. The spout is secured to the mixing chamber through the use of another collar. This collar is assembled around the spout and includes internal threads for mating with external threads on the mixing chamber.

The generally U-shaped fuel trap connects the conduit defined by the fuel control valve and the fuel intake opening of the mixing chamber. In other words, the fuel trap defines a pathway for delivering fuel from the fuel control valve to the mixing chamber.

The oil control valve is mounted on the mixing chamber for controlling oil flowing to the internal volume through the oil intake opening. The oil control valve defines an opening in registry with the screw-receiving boss of the mixing chamber to receive a screw or a similar fastener to secure the oil control valve to the mixing chamber. The oil control valve defines multiple orifices, each having a different diameter that corresponds to a flow of oil for a predetermined fuel-to-oil ratio. The oil control valve is also fan-shaped and designed to pivot about the axis defined by the screw, such that a user can selectively place any of the orifices defined by the oil control valve in registry with the oil intake opening defined by the mixing chamber. As such, a pathway is defined for oil from the oil reservoir, through the oil trap and the conduit defined through the fuel control valve, through a selected orifice of the oil control valve, and then into the mixing chamber via the oil intake opening.

To use the exemplary fuel and oil mixing device, a user places a predetermined amount of fuel and oil in the respective reservoirs. The user then adjusts the oil control valve such that the orifice with the proper diameter for achieving the desired fuel-to-oil ratio is in registry with both the oil intake opening in the mixing chamber and the oil conduit defined by the fuel control valve. To assist the user in adjusting the oil control valve, the oil control valve preferably includes an extension that serves as a knob or control for facilitating rotation of the oil control valve by a user. To further assist the user in selecting the proper setting, each orifice of the oil control valve preferably includes a marking that is viewable by the user and corresponds to its particular fuel-to-oil ratio. The oil control valve may also be rotated into a position such that the oil intake opening is completely blocked, so that only fuel will be introduced into the mixing chamber, allowing the device to be used as a traditional fuel dispenser.

In any event, when the fuel and oil mixing device is in a generally horizontal orientation, oil and fuel do not flow. As the user tilts the device, the S-shape of the oil trap prevents oil from prematurely flowing through the oil trap to the internal volume of the mixing chamber. Likewise, the U-shape of the fuel trap prevents fuel from prematurely flowing through the fuel trap to the internal volume of the mixing chamber.

As the tilt angle becomes greater, oil travels through the oil trap and the conduit defined through the fuel control valve until it reaches the oil control valve. As the oil passes through the selected orifice of the oil control valve, the diameter of the orifice regulates the flow of oil into the internal volume of the mixing chamber. Simultaneously, fuel flows from the fuel reservoir through the conduit in the fuel control valve. The conduit is sized to appropriately restrict the flow of fuel traveling to the fuel trap. The fuel travels through the fuel trap and into the internal volume of the mixing chamber. The fuel trap is configured such that the fuel flowing from the fuel reservoir into the internal volume of the mixing chamber is coordinated with the flow of oil into the internal volume of the mixing chamber so the proper amounts of fuel and oil are delivered into the spout, notwithstanding the amount of fuel or oil remaining in each respective reservoir.

As the tilt angle increases further still, the fuel-oil mixture flows out of the outlet of the mixing chamber into the spout. The spout is corrugated to create turbulence for continued mixing of the oil and fuel and to allow for increased flexibility of the spout.

Thus, the fuel and oil mixing device of the present invention allows a user to easily select the ratio of fuel to oil in the mixture that exits the device, thereby allowing a single device to be used to fill multiple two-stroke engines.

DETAILED DESCRIPTION OF THE INVENTION

The present invention is a fuel and oil mixing device that holds a quantity of fuel and oil and allows a user to easily select the ratio of fuel to oil in the mixture that exits the device, thus allowing a single device to be used to fill multiple two-stroke engines.

Figure 1:
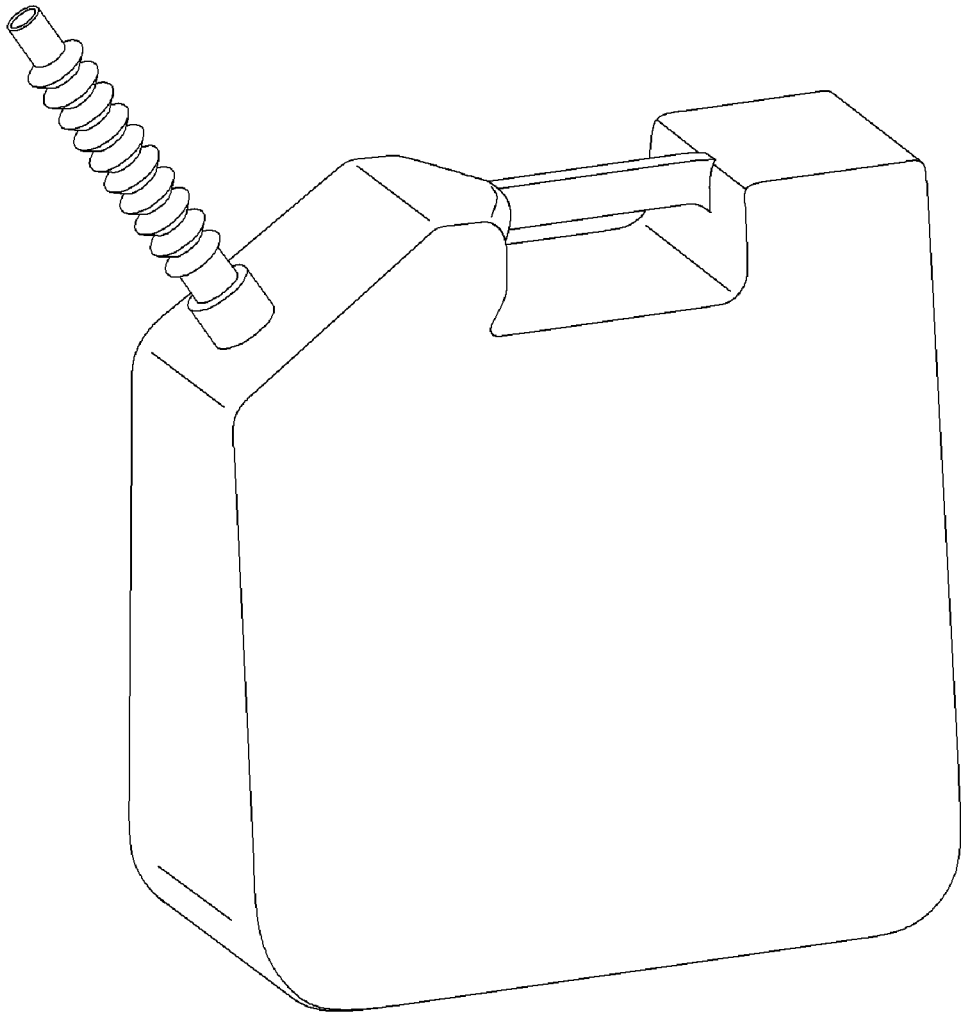
FIG. 1 (PRIOR ART)
FIG. 1 is a perspective view of a common, prior art fuel reservoir.

FIG. 1 is a perspective view of a common, prior art fuel reservoir or container, i.e., a "gas can." In most cases, fuel and oil can be maintained in separate gas cans, and then manually metered into and mixed in a third gas can. Because many people own more than one device that employs a two-stroke engine and each two-stroke engine generally requires its own particular ratio of fuel to oil, owners of more than one device using a two-stroke engine must have numerous prior art gas cans that are individually tailored to particular two-stroke engines. Thus, a single device that can be used to fill multiple two-stroke engines would be more flexible than prior art gas cans.

Figure 2:
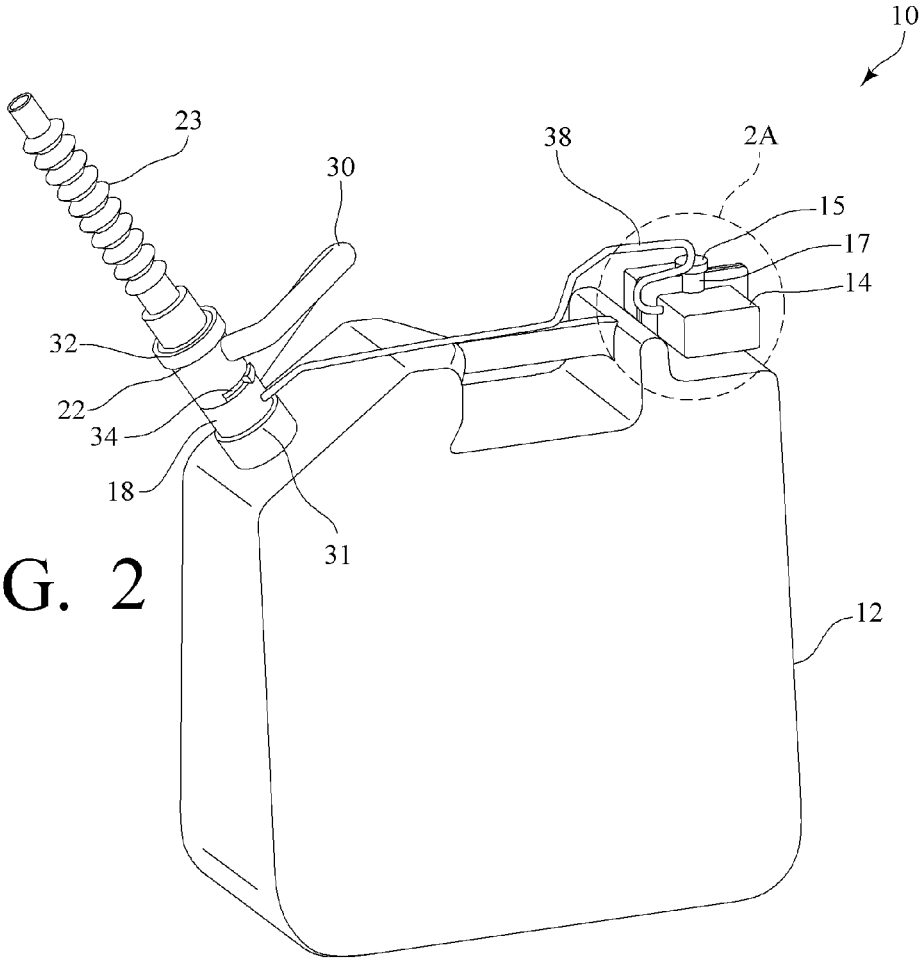
FIG. 2 is a perspective view of an exemplary fuel and oil mixing device made in accordance with the present invention.
Figure 3:
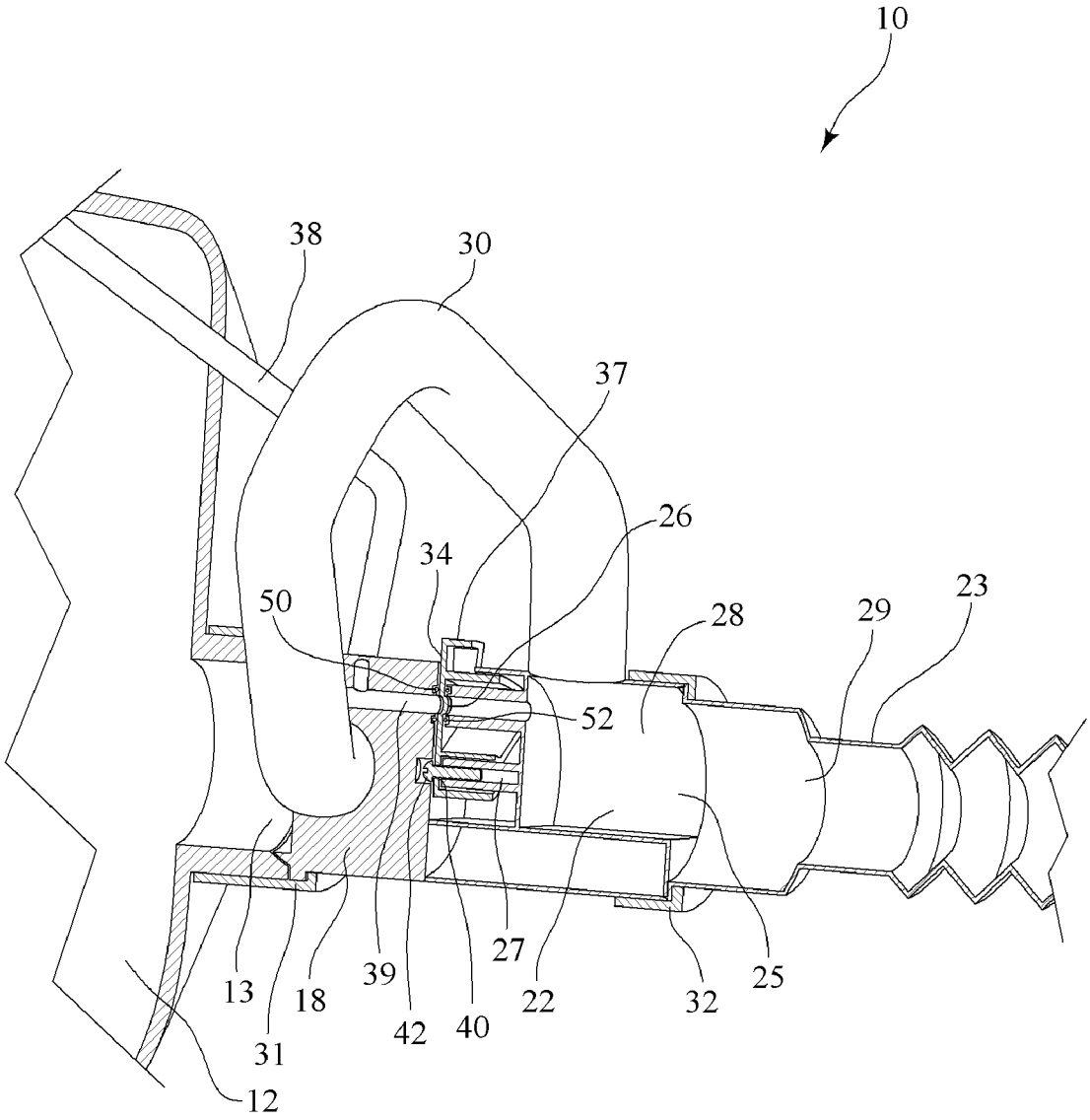
FIG. 3 is a cross-sectional perspective view of a portion of the exemplary fuel and oil mixing device of FIG. 2.
Figure 4:
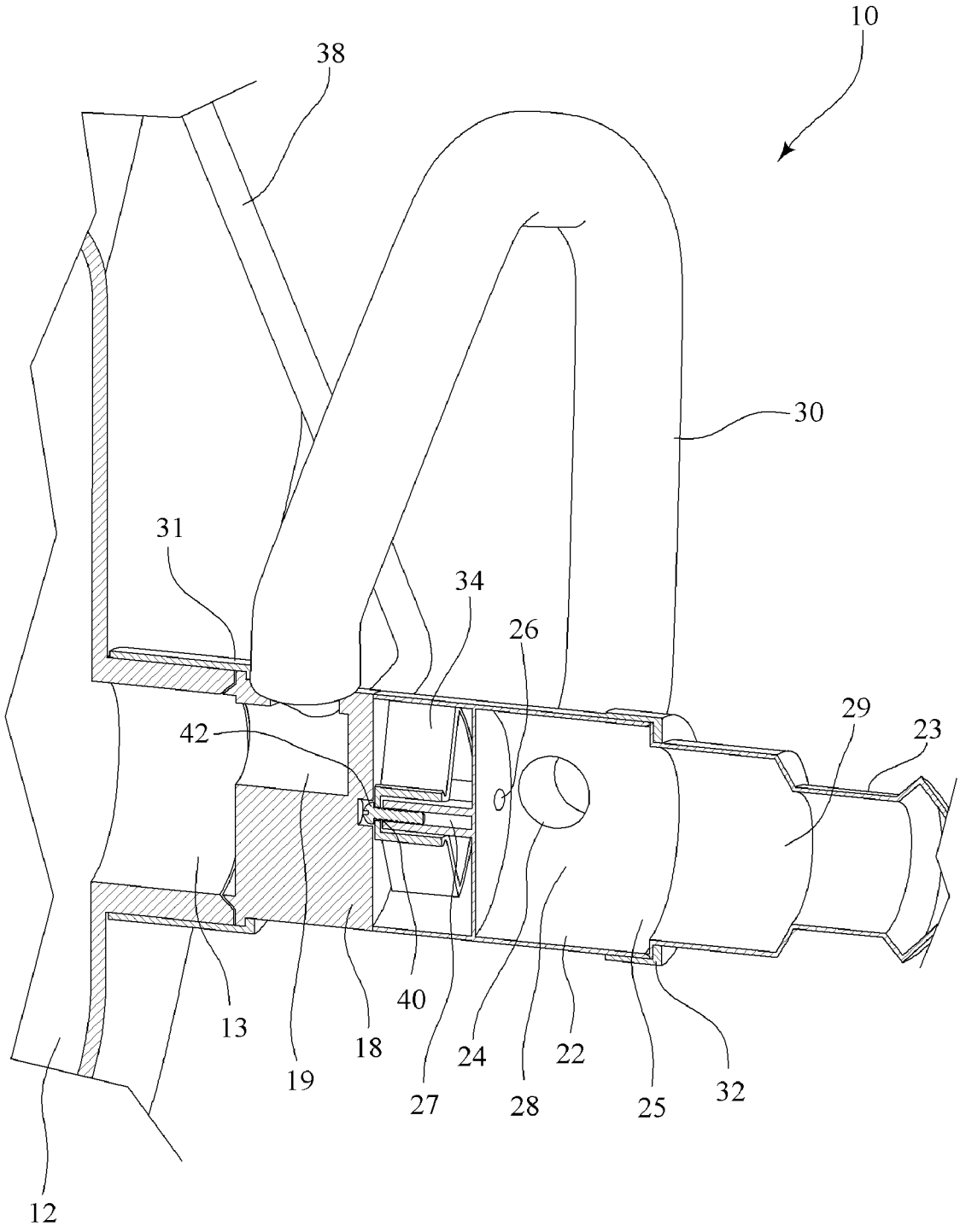
FIG. 4 is another cross-sectional perspective view of a portion of the exemplary fuel and oil mixing device of FIG. 2.

Referring now to FIGS. 2-4, an exemplary fuel and oil mixing device 10 includes a fuel reservoir 12 for holding a quantity of fuel, with this fuel reservoir 12 defining an opening 13 for exit of the fuel, as is further described below. An oil reservoir 14 is secured to and supported by the fuel reservoir 12, and holds a quantity of oil. The oil reservoir 14 is positioned near the rear of the fuel reservoir 12, such that potential energy is produced in the oil when the fuel and oil mixing device 10 is manipulated and tilted forward to dispense fuel from the fuel reservoir 12.

Figure 2A:
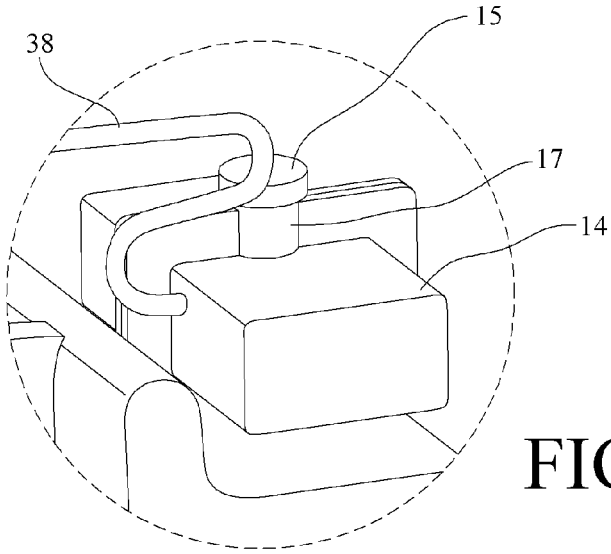
FIG. 2A is an enlarged perspective view of a portion of the exemplary fuel and oil mixing device of FIG. 2, illustrating the oil reservoir.

Referring now to FIG. 2A, the oil reservoir 14 defines an exterior fill hole 17 and an opening (not shown), which allows oil to exit from the oil reservoir 14 through a generally S-shaped oil trap 38, which defines a pathway for oil from the oil reservoir 14 to the remaining components of the device 10, as is further described below. The exterior fill hole 17 is preferably fitted with a screw cap 15, which may include a vent (not shown) to prevent a vacuum in the oil reservoir 14 as the oil exits the reservoir 14 through the oil trap 38.

Figure 5:
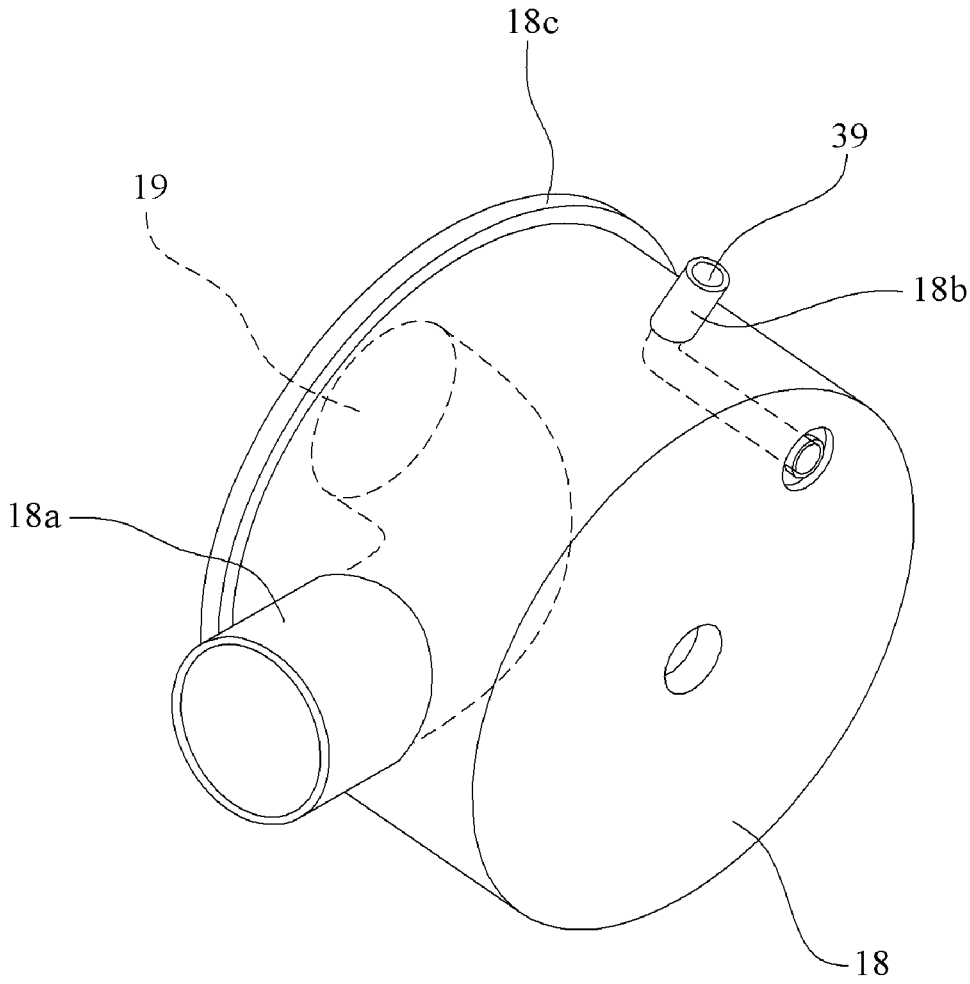
FIG. 5 is a perspective view of the fuel control valve of the exemplary fuel and oil mixing device of FIG. 2.

Referring now to FIGS. 3-4 and the view of the fuel control valve 18 in FIG. 5, the fuel control valve 18 is generally cylindrical in shape and defines a fuel conduit 19, that, when assembled with the remaining components of the fuel and oil mixing device 10 (as best shown in FIG. 4), is in registry with the opening 13 through which fuel exits the fuel reservoir 12. A mixing chamber 22 is then connected to the fuel control valve 18, such that fuel will flow through the a fuel conduit 19 defined by the fuel control valve 18 and into the mixing chamber 22 via a generally U-shaped fuel trap 30, as is further described below. With respect to the connection of the mixing chamber 22 to the fuel control valve 18, various fasteners and/or an adhesive could be used to connect these two components. For example, although not shown in the Figures, it is contemplated that one or both of the mixing chamber 22 and the fuel control valve 18 could be provided with integral projections or tabs that would mate with corresponding slots on the other component, effectively locking the mixing chamber 22 to the fuel control valve 18 together.

In any event, a conduit 39 is also defined through the fuel control valve 18 for the passage of oil from the oil trap 38. In this regard, the fuel control valve 18 includes a protrusion 18*b* in registry with the conduit 39, so that the distal end of the oil trap 38 can be pressed over and into engagement with the protrusion 18*b*.

Finally, the fuel control valve 18 is secured to the fuel reservoir 12 through the use of a collar 31. The collar 31 is assembled around the fuel control valve 18, engaging an integral circumferential lip 18*c* of the fuel control valve 18, with the collar 31 including internal threads for mating with external threads (not shown) on the fuel reservoir 12, much in the same manner that a spout is secured to a common, prior art fuel reservoir or container. Specifically, the fuel reservoir 12 includes an angled or chamfered surface on the inner circumference of the opening 13. Thus, when the collar 31 is assembled around the fuel control valve 18, the circumferential lip 18*c* of the fuel control valve 18 is pressed into engagement with the angled or chamfered surface to form a leak-proof seal.

Figure 6:
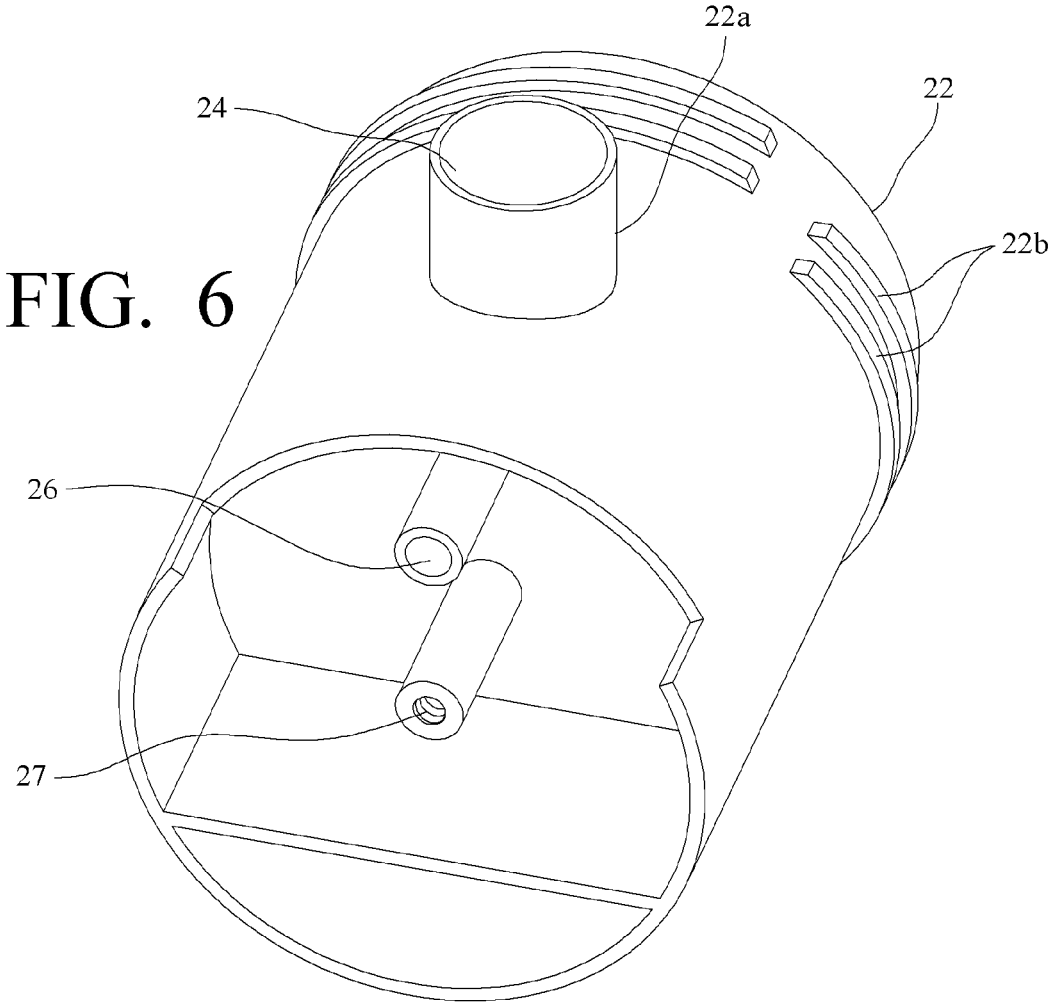
FIG. 6 is a perspective view of the mixing chamber of the exemplary fuel and oil mixing device of FIG. 2.

Referring now to FIGS. 3, 4, and 6, the mixing chamber 22 is also generally cylindrical in shape and defines an internal volume 28. The mixing chamber 22 also defines a fuel intake opening 24, an oil intake opening 26, and a screw-receiving boss 27. Finally, as best illustrated in FIGS. 3 and 4, the mixing chamber 22 defines an outlet 25, which is in registry with a conduit 29 defined by a spout 23, with the fuel-oil mixture exiting the device 10 through the spout 23, as is further described below. The spout 23 is secured to the mixing chamber 22 through the use of another collar 32. Similar to the collar 31 that secures the fuel control valve 18 to the fuel reservoir 12, this collar 32 is assembled around the spout 23 and includes internal threads for mating with external threads 22*b* on the mixing chamber 22, with a leak-proof seal being formed between the mixing chamber 22 and the spout 23.

Referring now to FIGS. 2-6, the generally U-shaped fuel trap 30 connects the conduit 19 defined by the fuel control valve 18 and the fuel intake opening 24 of the mixing chamber 22 for delivering fuel to the internal volume 28. In other words, the fuel trap 30 defines a pathway for delivering fuel from the fuel control valve 18 to the mixing chamber 22. In this regard, and as best illustrated in FIG. 5, the fuel control valve 18 includes a protrusion 18*a* in registry with the conduit 19. Similarly, and as best illustrated in FIG. 6, the mixing chamber 22 includes a protrusion 22*a* circumscribing the fuel intake opening 24. The fuel trap 30 is preferably comprised of rubber or a similar material with some flexibility, and having an internal diameter slightly less than the external diameter of the protrusions 18*a*, 22*a*, so that the respective ends of the fuel trap 30 can be pressed over and into engagement with the protrusions 18*a*, 22*a*.

Figure 7:
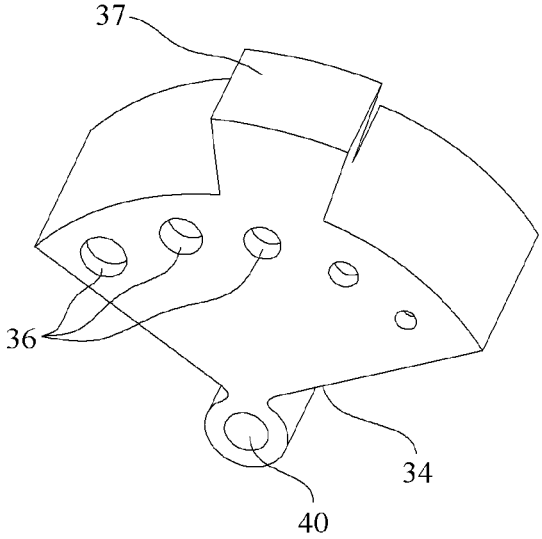
FIG. 7 is a perspective view of the oil control valve of the exemplary fuel and oil mixing device of FIG. 2.
Figure 8:
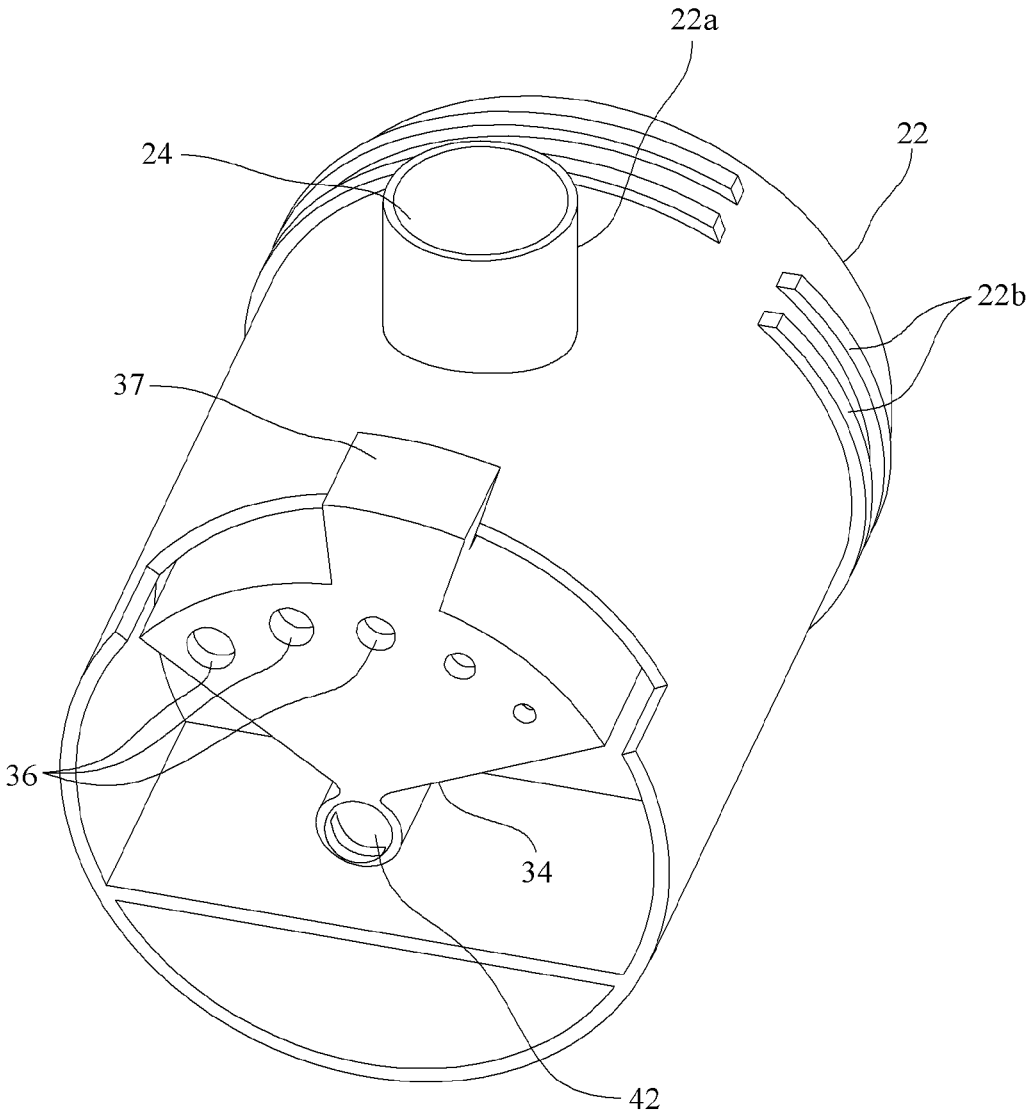
FIG. 8 is a perspective view of the oil control valve mounted on the mixing chamber in the exemplary fuel and oil mixing device of FIG. 2.

Referring still to FIGS. 2-4 and the views of the oil control valve 34 in FIGS. 7 and 8, the oil control valve 34 is mounted on the mixing chamber 22 for controlling oil flowing to the internal volume 28 through the oil intake opening 26. The oil control valve 34 defines an opening 40 (as illustrated in FIG. 6) in registry with the screw-receiving boss 27 of the mixing chamber 22 to receive a screw 42 or a similar fastener to secure the oil control valve 34 to the mixing chamber 22. The oil control valve 34 defines multiple orifices 36, as best illustrated in FIG. 7, each having a different diameter that corresponds to a flow of oil for a predetermined fuel-to-oil ratio. The oil control valve 34 is also fan-shaped and designed to pivot about the axis defined by the screw 42, such that a user can selectively place any of the orifices 36 defined by the oil control valve 34 in registry with the oil intake opening 26 defined by the mixing chamber 22. As such, a pathway is defined for oil from the oil reservoir 14, through the oil trap 38 and the conduit 39 defined through the fuel control valve 18, through a selected orifice 36 of the oil control valve 34, and then into the mixing chamber 22 via the oil intake opening 26. In this regard, and as best illustrated in FIG. 3, an o-ring 50 is preferably used as a seal at the interface between the fuel control valve 18 and the oil control valve 34, while a similar o-ring 52 is preferably used as a seal at the interface between the oil control valve 34 and the oil intake opening 26 of the mixing chamber 22.

Referring now to FIGS. 9A-9D, to use the exemplary fuel and oil mixing device 10, a user places a predetermined amount of fuel and oil in the respective reservoirs 12, 14. The user then adjusts the oil control valve 34 such that an orifice 36 with the proper diameter for achieving the desired fuel-to-oil ratio is in registry with both the oil intake opening 26 in the mixing chamber 22 and the oil conduit 39 defined by the fuel control valve 18. To assist the user in adjusting the oil control valve 34, the oil control valve 34 preferably includes an extension 37 that serves as a knob or control for facilitating rotation of the oil control valve 34 by a user. To further assist the user in selecting the proper setting, each orifice 36 of the oil control valve 34 preferably includes a marking (not shown) that is viewable by the user and corresponds to its particular fuel-to-oil ratio. The oil control valve 34 may also be rotated into a position such that the oil intake opening 26 is completely blocked, so that only fuel will be introduced into the mixing chamber 22, allowing the device 10 to be used as a traditional fuel dispenser.

Figure 9A:
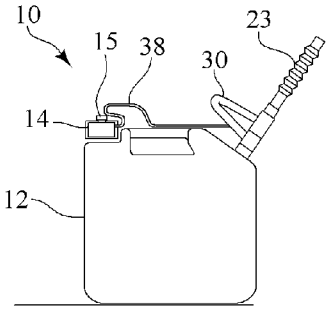
FIGS. 9A-9D are a series of illustrations demonstrating the use of the exemplary fuel and oil mixing device of FIG. 2.
Figure 9B:
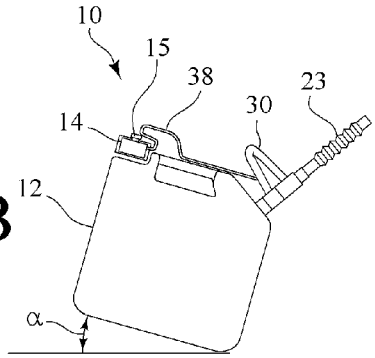

In any event, when the fuel and oil mixing device 10 is in a generally horizontal orientation as in FIG. 9A (tilt angle, $\alpha=0$), oil and fuel do not flow. As the user tilts the device 10, as in FIG. 9B, the S-shape of the oil trap 38 prevents oil from prematurely flowing through the oil trap 38 to the internal volume 28 of the mixing chamber 22. Likewise, the U-shape of the fuel trap 30 prevents fuel from prematurely flowing through the fuel trap 30 to the internal volume 28 of the mixing chamber 22.

Figure 9C:
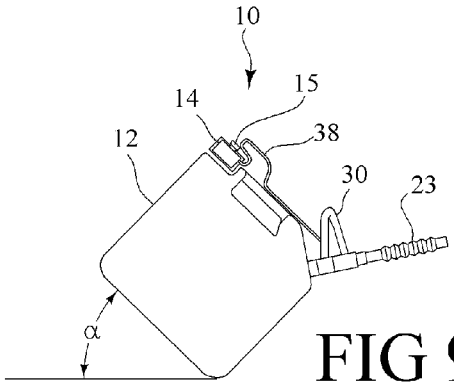

As the tilt angle, $\alpha$, becomes greater, as in FIG. 9C, oil travels through the oil trap 38 and the conduit 39 defined through the fuel control valve 18 until it reaches the oil control valve 34. As the oil passes through the selected orifice 36 of the oil control valve 34, the diameter of the orifice 36 regulates the flow of oil into the internal volume 28 of the mixing chamber 22. Simultaneously, fuel flows from the fuel reservoir 12 through the conduit 19 defined through the fuel control valve 18. The conduit 19 is sized to appropriately restrict the flow of fuel traveling to the fuel trap 30. The fuel travels through the fuel trap 30 and into the internal volume 28 of the mixing chamber 22. The fuel trap 30 is configured such that the fuel flowing from the fuel reservoir 12 into the internal volume 28 of the mixing chamber 22 is coordinated with the flow of oil into the internal volume 28 of the mixing chamber 22 so the proper amounts of fuel and oil are delivered into the spout 23, notwithstanding the amount of fuel or oil remaining in each respective reservoir 12, 14. Thus, fuel flowing through the fuel trap 30 to the internal volume 28 mixes with oil flowing through the oil control valve 34 to the internal volume 28 and a mixture of fuel and oil flows out of the outlet 25.

Figure 9D:
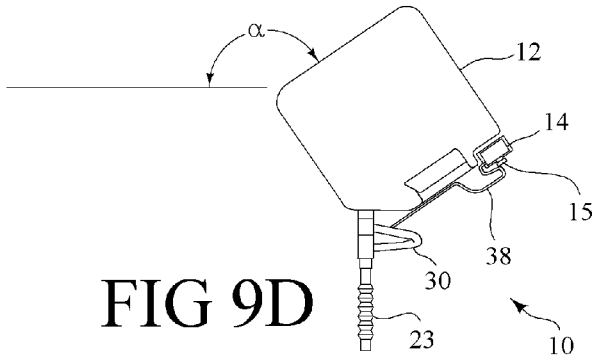

As the tilt angle, $\alpha$, increases further still, as in FIG. 9D, the fuel-oil mixture flows out of the outlet 25 of the mixing chamber 22 into the spout 23. The spout 23 is corrugated to create turbulence for continued mixing of the oil and fuel and to allow for increased flexibility of the spout 23.

Thus, the fuel and oil mixing device 10 of the present invention allows a user to easily select the ratio of fuel to oil in the mixture that exits the device 10, thereby allowing a single device to be used to fill multiple two-stroke engines.

One of ordinary skill in the art will recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A fuel and oil mixing device, comprising:

a fuel reservoir for holding a quantity of fuel and defining an opening for exit of said fuel;

an oil reservoir secured to said fuel reservoir for holding a quantity of oil and defining an opening for exit of said oil;

a fuel control valve connected to the fuel reservoir, said fuel control valve defining a fuel conduit in registry with the opening defined by the fuel reservoir for exit of said fuel and further defining an oil conduit;

a mixing chamber defining an internal volume, said mixing chamber being connected to the fuel control valve at one end and connected to a spout at another end, said mixing chamber further defining a fuel intake opening, an oil intake opening, and an outlet in registry with the spout;

a fuel trap connecting the fuel intake opening of the mixing chamber and the fuel conduit defined by the fuel control valve for delivering said fuel from the fuel control valve to the mixing chamber, wherein said fuel trap is generally U-shaped to prevent said fuel from prematurely flowing through said fuel trap into the mixing chamber;

an oil control valve defining a multiplicity of orifices, each of which can be selectively placed in registry with the oil intake opening defined by said mixing chamber and the oil conduit defined by said fuel control valve, and each of the multiplicity of orifices corresponding to a predetermined fuel-to-oil ratio; and an oil trap connected between said oil reservoir and the oil conduit defined by said fuel control valve;

wherein, as a user tilts the fuel and oil mixing device forward, fuel flowing into the mixing chamber through the fuel intake opening mixes with oil flowing into the mixing chamber through the oil intake opening, with a fuel-oil mixture exiting through the outlet of the mixing chamber with a fuel-to-oil ratio determined by the orifice selected and placed in registry with the oil intake opening defined by said mixing chamber and the oil conduit defined by said fuel control valve.

2. A fuel and oil mixing device, comprising:

a fuel reservoir for holding a quantity of fuel and defining an opening for exit of said fuel;

an oil reservoir secured to said fuel reservoir for holding a quantity of oil and defining an opening for exit of said oil;

a fuel control valve connected to the fuel reservoir, said fuel control valve defining a fuel conduit in registry with the opening defined by the fuel reservoir for exit of said fuel and further defining an oil conduit;

a mixing chamber defining an internal volume, said mixing chamber being connected to the fuel control valve at one end and connected to a spout at another end, said mixing chamber further defining a fuel intake opening, an oil intake opening, and an outlet in registry with the spout;

a fuel trap connecting the fuel intake opening of the mixing chamber and the fuel conduit defined by the fuel control valve for delivering said fuel from the fuel control valve to the mixing chamber;

an oil control valve defining a multiplicity of orifices, each of which can be selectively placed in registry with the oil intake opening defined by said mixing chamber and the oil conduit defined by said fuel control valve, and each of the multiplicity of orifices corresponding to a predetermined fuel-to-oil ratio; and an oil trap connected between said oil reservoir and the oil conduit defined by said fuel control valve, wherein said oil trap is generally S-shaped to prevent said oil from prematurely flowing through said oil trap into the mixing chamber;

wherein, as a user tilts the fuel and oil mixing device forward, fuel flowing into the mixing chamber through the fuel intake opening mixes with oil flowing into the mixing chamber through the oil intake opening, with a fuel-oil mixture exiting through the outlet of the mixing chamber with a fuel-to-oil ratio determined by the orifice selected and placed in registry with the oil intake opening defined by said mixing chamber and the oil conduit defined by said fuel control valve.

3. The fuel and oil mixing device of claim 1, wherein said oil control valve pivots about an axis, such that the user can selectively place any of the orifices defined by the oil control valve in registry with the oil intake opening defined by said mixing chamber and the oil conduit defined by said fuel control valve by rotating said oil control valve.

4. The fuel and oil mixing device of claim 3, wherein said oil control valve includes an extension that serves as a knob for facilitating rotation of said oil control valve by the user.

5. The fuel and oil mixing device of claim 3, wherein said oil control valve can be rotated into a position such that the oil intake opening is completely blocked, so that only fuel will be introduced into the mixing chamber.

6. A fuel and oil mixing device, comprising:

a fuel reservoir for holding a quantity of fuel;

an oil reservoir secured to said fuel reservoir for holding a quantity of oil;

a mixing chamber secured to said fuel reservoir, and defining an internal volume, a fuel intake opening, an oil intake opening, and an outlet;

a fuel trap for delivering fuel into the mixing chamber from the fuel reservoir through the fuel intake opening, wherein said fuel trap is generally U-shaped to prevent said fuel from prematurely flowing through said fuel trap into the mixing chamber;

a means for delivering oil into the mixing chamber from the oil reservoir through the oil intake opening; and an oil control valve for controlling oil flowing into the mixing chamber through the oil intake opening and defining a multiplicity of orifices, each which can be selectively placed in registry with the oil intake opening of said mixing chamber, and each of the multiplicity of orifices corresponding to a predetermined fuel-to-oil ratio;

wherein, as a user tilts the fuel and oil mixing device forward, fuel flowing into the mixing chamber through the fuel intake opening mixes with oil flowing into the mixing chamber through the oil intake opening, with a fuel-oil mixture exiting through the outlet of the mixing chamber with a fuel-to-oil ratio determined by the orifice selected and placed in registry with the oil intake opening of said mixing chamber.

7. The fuel and oil mixing device of claim 6, and further comprising a fuel control valve interposed between said fuel reservoir and said mixing chamber, said fuel control valve defining a fuel conduit in registry with an opening defined by the fuel reservoir for exit of said fuel from said fuel reservoir, said fuel conduit delivering fuel to said fuel trap, which then delivers fuel into the mixing chamber through the fuel intake opening.

8. The fuel and oil mixing device of claim 7, wherein said means for delivering oil into the mixing chamber from the oil reservoir includes: an oil trap extending from the oil reservoir to said fuel control valve and an oil conduit defined through said fuel control valve.

9. The fuel and oil mixing device of claim 8, wherein said oil trap is generally S-shaped to prevent said oil from prematurely flowing through said oil trap into the mixing chamber.

10. The fuel and oil mixing device of claim 6, wherein said oil control valve pivots about an axis, such that the user can selectively place any of the orifices defined by the oil control valve in registry with the oil intake opening of said mixing chamber by rotating said oil control valve.

11. The fuel and oil mixing device of claim 10, wherein said oil control valve includes an extension that serves as a knob for facilitating rotation of said oil control valve by the user.

12. The fuel and oil mixing device of claim 10, wherein said oil control valve can be rotated into a position such that the oil intake opening is completely blocked, so that only fuel will be introduced into the mixing chamber.

13. The fuel and oil mixing device of claim 3, wherein said oil control valve is generally fan-shaped, with each of the orifices defined through a face of the generally fan-shaped oil control valve.

14. The fuel and oil mixing device of claim 13, wherein the orifices are aligned in an arc along the face of the generally fan-shaped oil control valve.

15. The fuel and oil mixing device of claim 10, wherein said oil control valve is generally fan-shaped, with each of the orifices defined through a face of the generally fan-shaped oil control valve.

16. The fuel and oil mixing device of claim 15, wherein the orifices are aligned in an arc along the face of the generally fan-shaped oil control valve.

17. The fuel and oil mixing device of claim 2, wherein said oil control valve pivots about an axis, such that the user can selectively place any of the orifices defined by the oil control valve in registry with the oil intake opening defined by said mixing chamber and the oil conduit defined by said fuel control valve by rotating said oil control valve.

18. The fuel and oil mixing device of claim 17, wherein said oil control valve includes an extension that serves as a knob for facilitating rotation of said oil control valve by the user.

19. The fuel and oil mixing device of claim 17, wherein said oil control valve can be rotated into a position such that the oil intake opening is completely blocked, so that only fuel will be introduced into the mixing chamber.

* * * * *